United States Patent [19]

Kern

[11] Patent Number: 4,776,771

[45] Date of Patent: Oct. 11, 1988

[54] METERING PUMP

[75] Inventor: Hans Kern, Vachendorf, Fed. Rep. of Germany

[73] Assignee: Grunbeck Wasseraufbereitung GmbH, Hochstadt, Fed. Rep. of Germany

[21] Appl. No.: 89,225

[22] Filed: Aug. 25, 1987

[51] Int. Cl.[4] ..... F04B 43/04

[52] U.S. Cl. ..... 417/307; 417/374; 417/413; 92/98 R

[58] Field of Search ..... 92/98; 417/307, 374, 417/413, 415, 417

[56] References Cited

U.S. PATENT DOCUMENTS

| | | | |
|---|---|---|---|
| 1,860,283 | 5/1932 | Gulick | 417/413 X |
| 1,926,074 | 9/1933 | Warnke | 417/413 X |
| 2,289,215 | 6/1942 | Lotz | 417/413 X |
| 4,086,036 | 4/1978 | Hagen et al. | 417/413 X |
| 4,523,902 | 6/1985 | Wally | 417/417 |

*Primary Examiner*—Carlton R. Croyle
*Assistant Examiner*—Theodore Olds
*Attorney, Agent, or Firm*—Donald Brown; Robert T. Gammons

[57] ABSTRACT

A self-aspirating and self-bleeding metering pump comprises a metering chamber having an inlet connected with a predelivery chamber and an outlet connected with a metering point. The predelivery chamber is connected with a metering agent tank through a suction conduit comprising a suction valve and a return conduit comprising a head valve. Furthermore, a diaphragm for predelivering into the predelivery chamber is provided. A metering section of the diaphragm cooperates with the metering chamber for performing the metering stroke and comprises a separate drive serving this purpose. In this manner dynamically stressed sealing members are avoided, whereby the self-aspirating and self-bleeding metering pump is resistent also to the metering of aggressive media.

12 Claims, 2 Drawing Sheets

METERING PUMP

BACKGROUND OF THE INVENTION

The invention relates to a metering pump and in particular to a metering pump comprising a metering chamber having an inlet connected with a predelivery chamber and an outlet connected with a metering point.

A metering pump of this kind is known from the German utility model No. 77 33 135. In the known metering pumps which operate agains a counter pressure the entry of air or gas into the pump chamber results in a power reduction or even in a failure of the metering means operated by the pump. This effect occurs when the metering pump is put into service, the metering agent tank is exchanged and also when metering agents gas out. During the pressure stroke the gas is compressed in the pump chamber due to the counter pressure in the system and expands again during the suction stroke. This air cushion prevents the aspiration or displacement of the metering liquid. This effect occurs in particular in metering pumps with small stroke volume and high stroke frequency.

Conventional metering means such as piston diaphragm pumps are not suitable for metering aggressive media such as chlorine bleaching solution, since signs of wear appear very rapidly in particular in the piston packings and hence the service life of such pumps is rather short. Metering pumps suitable for aggressive media are known, but these pumps are not self-venting or self-bleeding, so that the venting or aeration must be performed by hand. This leads to an irregular pumping operation and interruptions.

OBJECTS OF THE INVENTION

It is an object of the invention to provide an improved metering pump in which the above mentioned drawbacks are avoided.

It is a further object to provide a metering pump which is self-aspirating and self-venting or self-bleeding, respectively.

It is a still further object of the invention to provide a metering pump which is resistent to aggressive media and hence suitable for metering aggressive media.

SUMMARY OF THE INVENTION

In order to achieve the above mentioned objects the invention provides a metering pump comprising a metering chamber which has an inlet thereof connected with a predelivery chamber at an outlet thereof connected with a metering point, said predelivery chamber being adapted to be connected with a metering agent tank through a suction conduit comprising a suction valve and a return conduit comprising a head valve, and a diaphragm for predelivering into said predelivery chamber, said diaphragm comprising a metering portion which cooperates with said metering chamber for performing the metering stroke and a drive for separately driving said metering portion to this end.

BRIEF DESCRIPTION OF THE DRAWINGS

Further advantages, features and objects of the invention will stand out from the following description of an exemplary embodiment with reference to the drawings, wherein.

DESCRIPTION OF A PREFERRED EMBODIMENT

Figure 1:
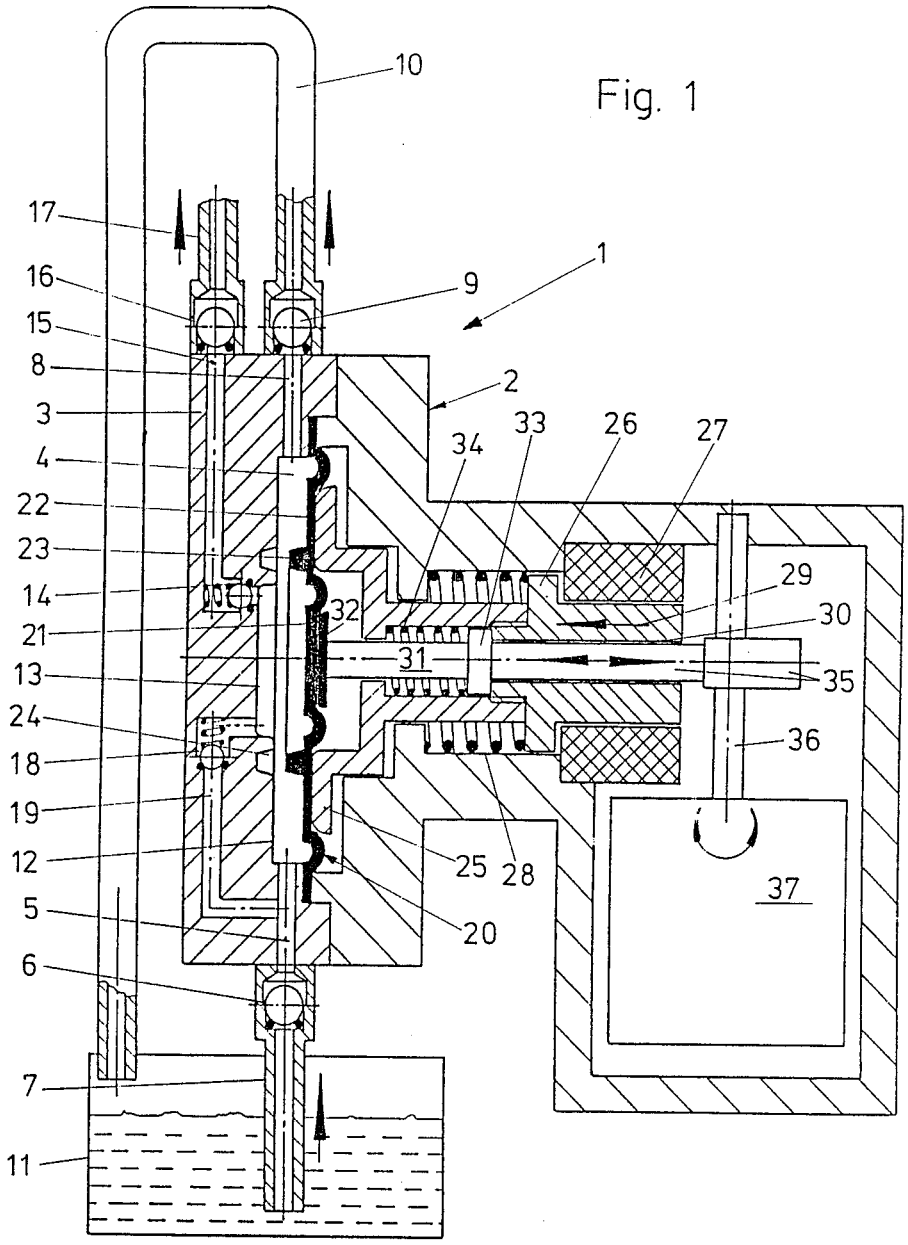
FIG. 1 is a sectional view of the inventive metering pump.

The metering pump 1 comprises a housing 2 with a pump head 3. A predelivery chamber 4 which has an annular form in the embodiment shown is provided in the pump head. The lower end of the predelivery chamber is connected with a suction conduit 7 comprising a suction valve 6 through a bore 5. Preferably the highest point, as seen in vertical direction, of the predelivery chamber is connected with a return conduit 10 comprising a head valve 9 through a bore 8. The metering pump may be connected in the manner shown in FIG. 1 with a metering agent tank 11 through the suction conduit 7 and the return conduit 10.

The one vertical wall 12 of the predelivery chamber 4 comprises a concentrically arranged annular depression which forms a metering chamber 13. The metering chamber 13 has the vertically highest point thereof connected with a metering channel 15 in a protected manner by a head or pressure valve 14. The metering channel itself is connected with a metering conduit 17 which comprises a head valve 16 and which leads to a metering point.

An overflow conduit 19 which is directly connected with the bore 5 and which comprises a suction valve 18, leads into the metering chamber at the vertically lower edge thereof.

A diaphragm 20 is provided opposite to the wall 12. The diaphragm 20 has an annular form shaped in conformity with the annular predelivery chamber and has the edge thereof clamped all-round. The diaphragm comprises a center portion which is denoted as metering portion 21 and a portion which annularly surrounds the metering portion and which is denoted as an outer portion 22. The diaphragm comprises an annular sealing ring 23 in between the portions 21 and 22. The wall 12 has an annular depression 24 surrounding the metering chamber 13 and facing the sealing ring 23 at a corresponding place. The dimensions of the annular depression and the seal 23 are selected such that the metering chamber 13 is sealed from the remaining part of the predelivery chamber 4 when the sealing ring engages the depression.

A thrust member 25 acts upon that region of the diaphragm 20 which comprises the outer portion 22 and the sealing ring 23. The thrust member is rigidly connected with an anchor member 26 in the manner shown in FIG. 1. The anchor member 26 is disposed coaxially in an electric lifting magnet 27 disposed within the housing 2. The anchor member and hence the thrust member is biased into the retracted position shown in FIG. 1 by means of a compression spring 28. The lifting magnet is designed such that the thrust member is moved, when the magnet is exited, through the anchor member in direction of the arrow 29 in such a manner that the diaphragm 20 is displaced towards the wall 12 and the sealing ring 23 is brought into tight engagement with the annular depression 24. When switching off the magnet, the thrust member and the diaphragm connected therewith is moved back into the position shown in FIG. 1 by action of the compression spring 28.

The anchor member 26 and the thrust member 25 each comprise a respective coaxial bore 30 in which a lifting tappet 31 is coaxially disposed. The lifting tappet has a plate 32 at the end thereof facing the diaphragm and engages the diaphragm on the rear or opposite side of the metering portion 21, being connected therewith. The tappet comprises a projection 33 which abuts the anchor member on its side opposite to the diaphragm and therefore limits an axial displacement into the anchor member beyond the position shown in FIG. 1. The side of the stop or projection facing the diaphragm serves as an abutment for a compression spring 34 which biases the tappet into the shown position in which the stop 33 contacts the anchor member. An excenter 35 is provided at that end of the tappet 31 which is opposite to the diaphragm. The excenter 35 is driven by a geared motor 37 through a shaft 36.

In operation the thrust member 25 is pressed to the right up to the stop for aspirating metering fluid, whereby the tappet 31 is simultaneously displaced into the shown retracted position. The diaphragm 20 moves away from the wall 12 and aspirates or sucks metering agent from the store tank 11. After having performed the sucking stroke the lifting magnet 27 is exited, whereby the thrust member and the tappet are displaced forwardly to direction of the arrow 29 through the anchor member 26. The annular sealing ring 23 is immersed into the annular depression 24 and is pressed against the bottom and the side walls of the depression such that the metering chamber 13 is hermetically sealed from the remaining predelivery chamber 4. The metering fluid now present in the metering chamber is completely separated from the liquid within the rest of the predelivery chamber. Air or aspirated gas rises upwards within the predelivery chamber in the aspirating operation and is pumped pressureless back into the store tank 11 by means of the outer portion 22 through the head valve 9 and the return conduit 10 together with the surplus metering liquid. The retaining force of the magnet 27 is selected such that the force is greater than the corresponding counter pressure in the system to be metered.

Now the excenter 35 is driven by the motor 37 such that the tappet 31 advances further into the metering chamber 13 in direction of the arrow 29 and presses the metering portion of the diaphragm into the metering chamber 13, whereby the liquid therein is delivered through the metering channel 15 into the metering conduit 17 to the metering point. Since the retaining force of the magnet 27 onto the sealing ring is greater than the counter force exerted by the liquid pressure in the system an escape of the metering agent into the predelivery chamber is prevented. Only after the excenter has passed its highest point and the tappet 13 has been returned together with the metering portion of the diaphragm by means of the spring force, the magnet 27 is switched off and the anchor member 26 is moved back together with the thrust member fixedly connected therewith by means of the compression spring 28, whereby again liquid is aspirated.

The overflow conduit 19 is provided in order to prevent the formation of a vacuum in the metering chamber 13 during the backward stroke of the diaphragm when the sealing ring is still closed. The suction valve opens when the pressure has decreased below atmospheric pressure and metering fluid flows into the metering chamber 13.

Figure 2:
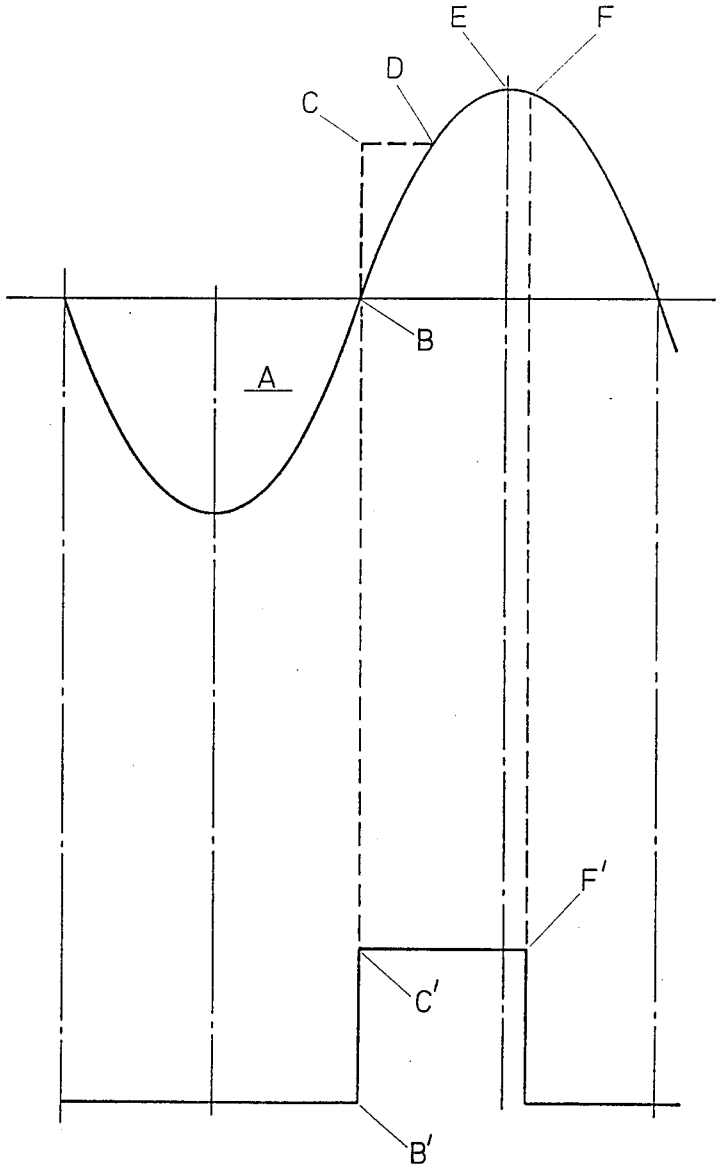
FIG. 2 is a schematic representation of the metering pump drive as a function of time.

The upper curve in FIG. 2 shows the movement of the excenter and hence that of the tappet, and the lower curve shows the movement of the anchor member or the excitement of the magnet, respectively. During the phase of the suction stroke A the excenter is moved such that the tappet 31 moves into the farthest retracted position at the time B. The anchor of the magnet is in its farthest retracted position B'. In the next phase the magnet 27 is operated such that the anchor and hence the thrust member are advanced in direction of the arrow 29 and the sealing ring 23 comes into sealing engagement with the annular depression 24 (C'). Simultaneously the tappet is advanced through its stop at the anchor member (C). The rotary motion of the excenter which is slightly slower than the advancement of the anchor member continues in a no-load operation from the point B to the point D and again strikes or contacts the tappet at this point whereby the tappet is further advanced towards a point E and performs its metering stroke. Shortly after the end of the metering stroke the excitement of the magnet is terminated at point F, so that the anchor is moved into its retracted position. In the meantime the tappet is pressed against the excenter and returns into the retracted position when the movement of the excenter continues. The drive of the magnet may for example be performed through cams at the excenter. A respective electric control unit has to be provided.

The diaphragm may for example be made of a material such as PTFE.

In place of the above described drive exclusively excenter drives, two lifting magnets or hydraulic or pneumatic cylinders may be provided.

In the described embodiment the predelivery chamber is connected with the metering agent tank 11 on the one hand directly through the bore 5 and on the other hand through the overflow conduit 19. According to a modified embodiment the connection to the suction conduit 7 is made exclusively through the overflow conduit 19, whereby a mechanical simplification is obtained. The embodiment shown, however, has the advantage that the remaining predelivery chamber 4, which is separated from the metering chamber 13 by means of the sealing ring 23, is directly connected with the suction conduit on the one hand and the return conduit on the other hand.

According to a possible modification of the drive the predelivery diaphragm 22 is, after the venting operation in the beginning, moved backwards only for e.g. each fifth or tenth stroke of the tappet 31. In this mode of operation, the metering agent is aspirated through the overflow conduit 19. The advantage of this control is a saving of the diaphragm and the seal 23 together with a simultaneous, permanently ensured venting or bleeding by means of the regular opening of the predelivery chamber. A control for driving the magnet 27 correspondingly is provided.

Although the invention has been described with reference to a specific example embodiment, it is to be understood that it is intended to cover all modifications and equivalents within the scope of the appended claims.

What is claimed is:

1. A metering pump for pumping a fluid comprising a metering chamber, a predelivery chamber in communication with the metering chamber, said predelivery chamber being of greater volume than the volume of the metering chamber and said predelivery chamber having an inlet and an outlet, means comprising a suction conduit connected with an inlet to the predelivery chamber such as to supply fluid via the suction conduit to the predelivery chamber, a suction valve in said conduit between the first end and the predelivery chamber, a return conduit having an outlet and being connected with the predelivery chamber to the tank, a discharge valve situated between the predelivery chamber and the outlet of the return conduit and a diaphragm in the predelivery chamber for inducing fluid from the tank into the predelivery chamber, said diaphragm comprising a metering portion and a discharge portion, said metering portion being movable relative to said discharge portion and, in cooperation with said metering chamber, operating to perform a metering stroke, and a first drive for moving both said diaphragm portions and a second drive means for separately driving said metering portion.

2. A metering pump comprising a metering chamber, a predelivery chamber in communication with the metering chamber, said predelivery chamber being of greater volume than the volume of the metering chamber and said predelivery chamber having an inlet and an outlet, means comprising a suction conduit having a first and a second and, the second end of which is connected with said inlet to the predelivery chamber such as to supply fluid via the suction conduit to the predelivery chamber, a suction valve in said conduit between said first end and the predelivery chamber, a return conduit having an outlet connected with the predelivery chamber, a discharge valve situated between the predelivery chamber and said outlet of the return conduit and a diaphragm in the predelivery chamber, said diaphragm comprising a metering portion and a discharge portion wherein said metering portion cooperates with said metering chamber to provide a metering stroke a first drive for moving both said diaphragm portions and a second drive for effecting movement of the metering portion of the diaphragm to perform said metering stroke.

3. The metering pump of claim 2, comprising a seal formed to separate said metering chamber which is acted upon by said metering portion from the remaining predelivery chamber in the metering stroke.

4. The metering pump of claim 2, wherein said metering portion is surrounded by an outer portion of said diaphragm on all sides.

5. The metering pump of claim 4, wherein said metering portion is disposed substantially coaxially to said outer portion.

6. The metering pump of claim 3, wherein said diaphragm comprises a sealing part which forms said seal and defines said metering portion from said outer portion.

7. The metering pump of claim 6, wherein said sealing part has an annular form and sealingly cooperates with an annular depression surrounding said metering chamber.

8. The metering pump of claim 2, comprising a first drive acting upon said metering portion during the metering stroke.

9. The metering pump of claim 4, comprising a second drive which acts at least upon said outer portion.

10. The metering pump of claim 8, wherein said second drive reciprocally moves said diaphragm between a retracted and an advanced position for performing the predelivery and wherein said first drive is switched on in said advanced position.

11. The metering pump of claim 9, wherein said second drive is designed to be moved into the advanced position by means of an electromagnet and into the retracted position by means of a compression spring.

12. The metering pump of claim 8, wherein said first drive is designed to be driven through a cam drive

* * * * *